US006181648B1

(12) United States Patent
Mafune et al.

(10) Patent No.: US 6,181,648 B1
(45) Date of Patent: Jan. 30, 2001

(54) ELECTRONIC WATCH EQUIPPED WITH SOLAR CELL

(75) Inventors: Masao Mafune, Tanashi; Osamu Kamisawa, Tokyo, both of (JP)

(73) Assignee: Citizen Watch Co., Ltd., Tokyo (JP)

( * ) Notice: Under 35 U.S.C. 154(b), the term of this patent shall be extended for 0 days.

(21) Appl. No.: 09/066,361

(22) PCT Filed: Sep. 11, 1997

(86) PCT No.: PCT/JP97/03208

§ 371 Date: Apr. 30, 1998

§ 102(e) Date: Apr. 30, 1998

(87) PCT Pub. No.: WO98/11473

PCT Pub. Date: Mar. 19, 1998

(30) Foreign Application Priority Data

Sep. 12, 1996 (JP) ..... 8-241568

(51) Int. Cl.[7] ..... G04C 10/00; G04C 17/00

(52) U.S. Cl. ..... 368/84; 368/242; 368/205

(58) Field of Search ..... 368/82, 67, 205, 368/228, 232, 234, 239, 242, 227, 223, 84

(56) References Cited

U.S. PATENT DOCUMENTS

| | | | | |
|---|---|---|---|---|
| 4,257,115 | * | 3/1981 | Hatuse et al. | 368/82 |
| 4,335,453 | * | 6/1982 | Fatton | 368/82 |
| 4,413,915 | * | 11/1983 | Besson | 368/71 |
| 4,555,184 | * | 11/1985 | Fujimori | 368/82 |
| 4,733,383 | * | 3/1988 | Waterbury | 368/10 |
| 4,785,436 | * | 11/1988 | Sase | 368/205 |
| 5,105,396 | * | 4/1992 | Ganter et al. | 368/47 |
| 5,202,858 | * | 4/1993 | Kanzaki | 368/82 |
| 5,761,158 | * | 6/1998 | Azuma et al. | 368/205 |
| 5,912,064 | * | 6/1999 | Azuma et al. | 368/205 |
| 5,966,344 | * | 10/1999 | Umemoto et al. | 368/88 |

FOREIGN PATENT DOCUMENTS

| | | |
|---|---|---|
| 52-55565 | 5/1977 | (JP) . |
| 53-41198 | 4/1978 | (JP) . |
| 59-32755 | 8/1984 | (JP) . |
| 61-63189 | 4/1986 | (JP) . |
| 5-196919 | 8/1993 | (JP) . |
| 7-198866 | 8/1995 | (JP) . |
| 8-54479 | 2/1996 | (JP) . |

* cited by examiner

*Primary Examiner*—Vit Miska
*Assistant Examiner*—Jeanne-Marguerite Goodwin
(74) *Attorney, Agent, or Firm*—Kanesaka & Takeuchi

(57) ABSTRACT

An electronic watch is formed of a case body having a display window, a movement situated in the case body, a light transmitting digital display disposed above the movement in the case body to be observed from an outside through the display window, and a solar cell unit. The solar cell unit is interposed between a part of the light transmitting digital display and the movement, and a reflecting plate is disposed under another part of the light transmitting digital display adjacent to the solar cell unit. Also, a light transmitting material is interposed between the part of the light transmitting digital display and the solar cell unit. Thus, light is supplied to the solar cell unit from the outside through the light transmitting digital display.

8 Claims, 5 Drawing Sheets

ELECTRONIC WATCH EQUIPPED WITH SOLAR CELL

FIELD OF THE INVENTION

This invention relates to an electronic watch equipped with solar cell, and, especially, to an electronic watch equipped with a solar cell provided with a digital display which has a large area for supplying light to a solar cell unit to generate sufficient power and allows the digital display to occupy a large area and to be easily seen, thereby realizing an ecological watch having a high product value.

DESCRIPTION OF THE BACKGROUND ART

In recent years, electronic watches provided with a solar cell unit have been proposed, in which electric power generated by the solar cell unit is charged to a condenser or a secondary battery and the generated power is utilized to drive these watches.

Such an electronic watch uses a solar cell unit as a power source so that no replacement of a cell is required. This technology has met a recent enhanced ecological demand and is hence rapidly becoming widespread throughout various fields.

Here, In the case of mounting a solar cell unit in an extremely small device such as a watch, it is necessary to supply with certainty sufficient light to a solar cell. Because of this, it is desirable that the solar cell unit be disposed at a dial portion possessing the largest area in the watch.

While, in simple analog type watches which display the time using three or two hands, the design of a dial is of the most importance. It is therefore undesirable for the design of the watch with a solar cell having a deep violet color, if such solar cell appears on a dial portion.

For the above reason, in conventional analog type watches, a solar cell unit is disposed on the dial and a light transmittable material with a white or another color is arranged on the solar cell to avoid direct exposure of the solar cell and thereby to improve the design of the watch while sufficient light is supplied to the solar cell.

At present, extremely simple and usual watches such as the aforementioned analog type watches which display the time using three or two hands are widely received in the market. On the other hand, unusual watches such as watches adopting a digital display using a liquid crystal cell or the like to display the time are also favorably received.

Such a digital display watch, however, has various structural problems when using a solar cell unit as a power source.

The analog type watch has no problem with its functions if a solar cell unit is disposed on the dial. Also, the design problem can be solved by arranging the light transmittable material with various colors on the solar cell.

However, in the digital display watches, when a solar cell unit is mounted on a digital display, the solar cell covers the digital display and hence the display is not viewed. It is therefore impossible to dispose a solar cell unit over the entire display in the same manner as in the analog watches.

If a solar cell unit is disposed below the digital display, there is the problem that light is not supplied to the solar cell. More concretely, a liquid crystal display material constituting a digital display is generally provided with a reflecting plate at the lowest side thereof to easily distinguish characters and the like displayed by a liquid crystal cell. If the solar cell unit is disposed below such a digital display in the above manner, incident light from the outside is reflected by the reflecting plate so that no light is supplied to the solar cell. It is therefore impossible to dispose the solar cell unit below the liquid display material in the conventional digital display electronic watches.

As a structure provided with a solar cell unit in the digital display watch, to date there has only been a structure such as disclosed, for example, in Japanese Patent Application Laid-open No. 287427/1990 in which a solar cell unit is disposed on a digital display at a position which never overlaps a liquid crystal cell. Such an arrangement is general at present.

However, in the structure in which the solar cell unit is disposed in such a manner as disclosed in Japanese Patent Application Laid-open No. 287427/1990, almost all parts of the watch surface on which the digital display is arranged are covered with the solar cell. Hence, the area for the digital display for displaying the essential time and the like is considerably narrowed, presenting a fatal problem for a watch inasmuch as the time and the like can be seen only with difficulty.

As outlined above, a structure for mounting a solar cell unit has important and serious problems in the case where it is intended to use the solar cell unit in digital display watches provided with a digital display composed of a liquid crystal and the like.

Incidentally, in recent years watches such as a wrist watch have been developed in which a light transmitting liquid crystal cell is used for a display to indicate the time, thereby providing a watch with an interesting effect.

Though such a watch itself has an interesting effect, it can never be a solar cell product which can meet an ecological demand since it uses a normal battery as a power source. Also, no technology in which a solar cell is mounted in such a watch provided with a light transmitting liquid crystal cell and is allowed to function efficiently as a watch material has as yet been proposed or realized.

Accordingly, the present invention has been achieved in view of this situation and has an object of providing a electronic watch equipped with a solar cell provided with a digital display which has a large area for supplying light to a solar cell to generate sufficient power and which allows the digital display to occupy a large area and to be easily seen, ensuring that the digital display has a large enough area to indicate multifunctional display portions, while at the same time it is an ecological watch in which a solar cell unit is mounted and characters and the like can be easily seen, bringing about a high product value.

DISCLOSURE OF THE INVENTION

The above objects can be attained in the present invention by the provision of an electronic watch comprising a case body provided with a display window; a movement situated in the case body; and a display which is disposed above the movement in the case body and can be observed from the outside through the display window, wherein the display is constituted of a light transmitting digital display means, a solar cell unit is interposed between the light transmitting digital display means and the movement, and light is supplied to the solar cell unit from the outside through the light transmitting digital display means.

The present invention is featured in that even if the solar cell unit is disposed below the digital display means, sufficient light can be transmitted and supplied to the solar cell unit via the light transmitting digital display means and at the same time the digital display means is allowed to occupy a large display area without any restriction from the solar cell unit.

In preferred embodiments of the present invention, a light transmittable material composed of a translucent material such as a ceramic or the like is disposed between the light transmitting digital display means and the solar cell unit.

In this embodiment, the light transmittable material allows incident light from the outside to be transmitted and to be supplied to a cell of the solar cell unit and reflects a part of the incident light to act as a reflecting plate for the digital display whereby displays such as characters and the like on the digital display can be seen more easily.

Apparently, though the present invention relates to an electronic watch provided with a digital display, it can provide a large area for supplying light to the solar cell to allow the solar cell to generate sufficient power and allows the digital display to occupy a large area and to be easily seen.

DETAILED DESCRIPTION OF THE INVENTION AND PREFERRED EMBODIMENTS

The present invention will now be explained in detail with reference to the appended drawings.

First Embodiment

First, a first embodiment of the present invention is explained with reference to FIGS. 1, 2, and 3.

Figure 1:
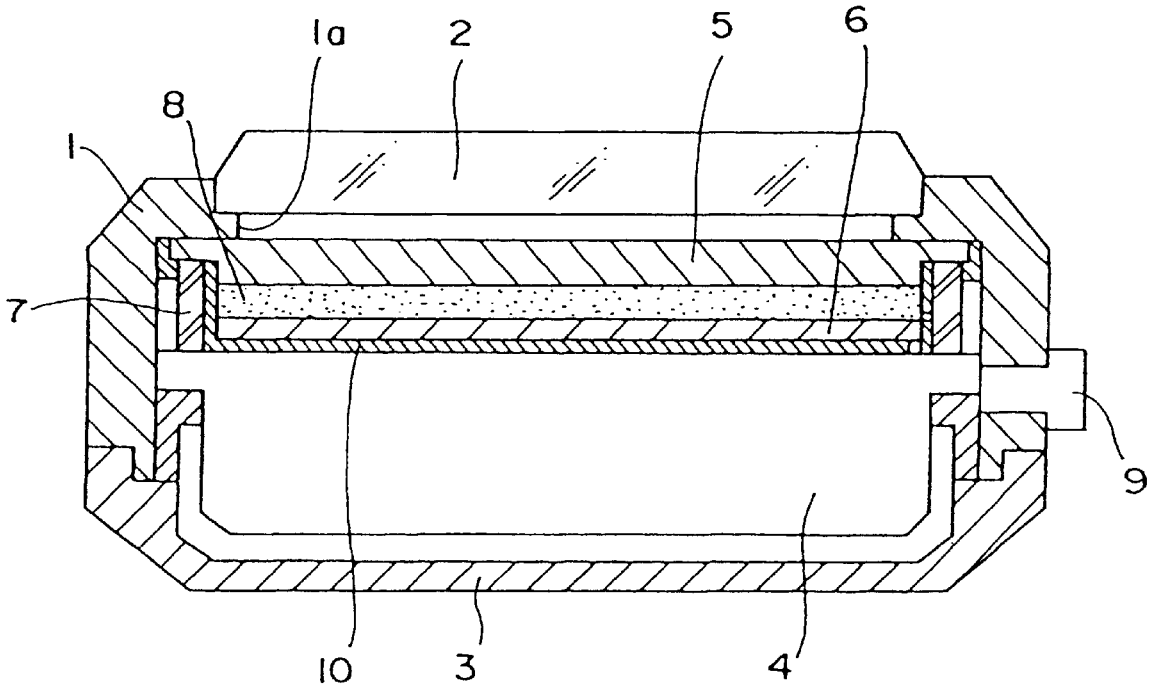
FIG. 1 is a sectional front view of a main portion showing a first embodiment of an electronic watch equipped with a solar cell according to the present invention.
Figure 2:
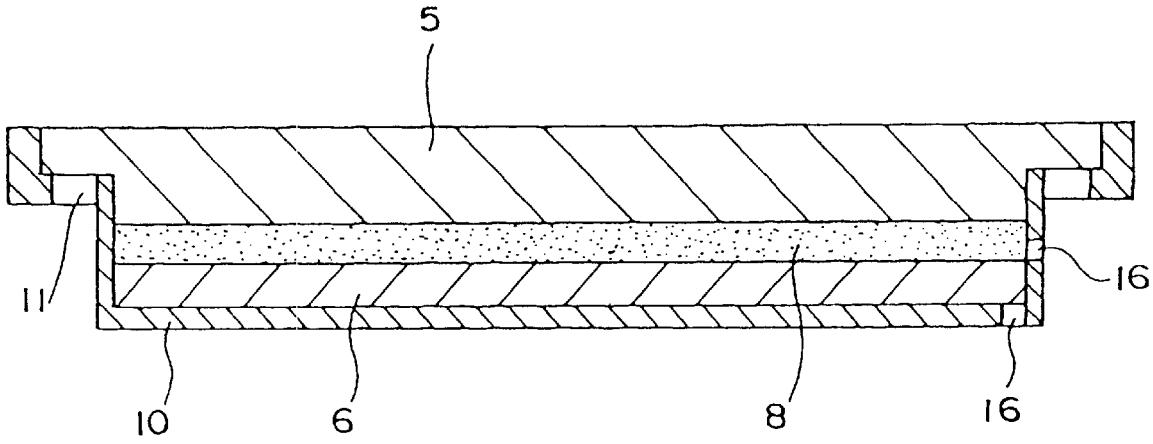
FIG. 2 is a sectional front view showing a main portion in the vicinity of a solar cell of the electronic watch equipped with a solar cell shown in FIG. 1.
Figure 3:
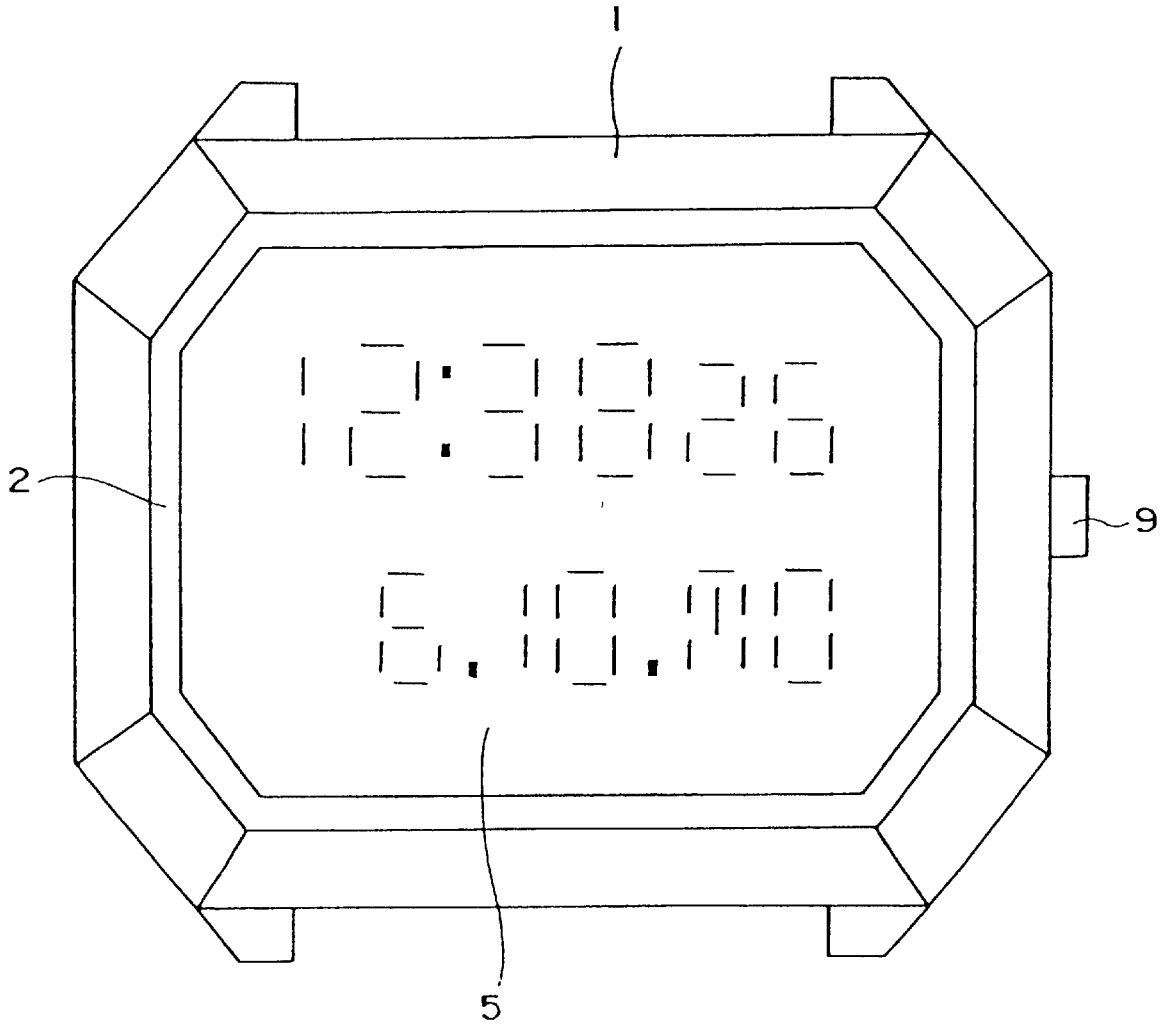
FIG. 3 is a plan view showing the finished condition of the electronic watch equipped with a solar cell shown in FIG. 1.

FIG. 1 is a sectional front view of a main portion showing a first embodiment of an electronic watch equipped with a solar cell according to the present invention, FIG. 2 is a sectional front view showing a main portion in the vicinity of a solar cell of the electronic watch shown in FIG. 1, and FIG. 3 is a plan view showing the finished condition of the electronic watch shown in FIG. 1.

As shown in these figures, an electronic watch of the present embodiment comprises a case body 1 provided with a display window 1*a;* a movement 4 situated in the case body 1; a display 5 which is disposed above the movement 4 in the case body 1 and can be observed from the outside via the display window 1*a*.

More concretely, the case body 1 of the watch is provided with the display window 1*a* in which a glass 2 is fitted and with a case back 3 at the side opposite to the glass 2.

Further, a push button 9 for adjusting the time and the like is disposed at the side of the case body 1.

A movement 4 for driving the watch is disposed at the side of the case back 3 inside the case body 1 of the watch. A display 5 for digitally displaying the time is disposed at the position facing the glass 2. This structure allows the display 5 to be observed from above the watch via the glass 2 and display window 1*a*.

In the present embodiment, the display 5 is constituted of a light transmitting digital display means, specifically, a light transmitting electro-optical display device.

This light transmitting electro-optical display device constituting the display 5 in the present invention has a structure in which only polarizing plates are disposed on the surface and back face of a cell, excluding a reflecting plate. However, a structure may be adopted in which a reflecting plate and a polarizing plate are united wherein only a part to which a voltage is applied is allowed to reflect light thereby allowing characters to appear, and the remainder is allowed to transmit light downward.

With this structure, incident light from the outside is transmitted through the display 5 constituted of the light transmitting electro-optical display device via the glass 2 and the display window 1*a* and is supplied to the inside of the case body 1.

Here, as shown in FIG. 1, the display 5 is formed in one larger size than the open area of the display window 1*a* and is formed to cover the entire display window 1*a*. Accordingly, the display 5 transmits all incident light entering into the display window 1*a*. Also, the display 5, which is formed in one larger size than the open area of the display window 1*a,* functions as a parting material for shielding an electroconductive rubber 7 described below.

In the present embodiment, a solar cell unit 6 is disposed below the light transmitting display 5, specifically between the display 5 and the movement 4, whereby the light which is transmitted through the display 5 is supplied to the cell of the solar cell unit 6 since the display 5 is a light transmitting type.

Furthermore, the solar cell unit 6 to which light is supplied generates power to drive the mechanism of the watch.

Incidentally, in place of a primary battery, a condenser or a secondary battery which requires no replacement is incorporated into the movement 4 on which the solar cell unit 6 is mounted. The power generated by the solar cell 6 is charged to the condenser or the secondary battery to drive the watch.

A circuit substrate (not shown) is disposed at the display side of the movement 4 and is electrically connected to the solar cell unit 6. The circuit substrate is also electrically connected to the display 5 constituted of the aforementioned light transmitting electro-optical display device by using the electroconductive rubber 7.

In addition, in the electronic watch of the present embodiment which is formed in this manner, a light transmitting material 8 is disposed between the light transmitting display 5 and the solar cell unit 6.

Generally, recent materials used for the solar cell unit 6 are amorphous so that a cell exhibits a deep violet color. Therefore, if the solar cell unit 6 is disposed below the light transmitting display 5, characters formed on the display 5 can be read only with difficulty since these have a color of the same type.

For this reason, in the present embodiment, the transmitting material 8 formed of a translucent material such as a ceramic or the like is disposed between the solar cell unit 6 and the display 5.

Here, the light transmitting material 8 is formed of a white translucent material composed of a ceramic in the present invention.

Since the light transmitting material 8 is formed of a translucent material, the light transmitting material 8 transmits a part of the light passing through the display 5 and reflects a part of the remainder to function as a reflecting plate.

Specifically, such a translucent material of which the light transmitting material 8 is formed generally transmits and reflects respectively about 50% of the incident light. The light transmitting material 8 formed of the translucent material is therefore allowed to function as a reflecting plate for the display 5. As outlined above, the present embodiment is featured in that a part of the incident light introduced into the watch is transmitted to the solar cell unit 6 and a part of the remainder is reflected to the side of the display 5.

Furthermore, in the present embodiment, the light transmitting material 8 is disposed so as to extend under the entire display 5 whereby light is not only transmitted to the solar cell unit 6 through all the light transmitting material 8 but also reflected to the display 5.

The translucent material constituting of the light transmitting material 8 is not limited to ceramics or the like to the extent that it is a so-called semi-transmitting material capable of transmitting light. Other than ceramics, materials in which a large number of through-holes are formed may be used. Also, any material may be used which can supply light to the solar cell unit 6 and can reflect light so that the characters such as time characters and the like formed on the display 5 can be read.

Here, the structure in the vicinity of the solar cell of the electronic watch formed in this manner in the present embodiment is now explained in more detail with reference to FIG. 2.

FIG. 2 is a sectional front view showing a main portion in the vicinity of a solar cell of the electronic watch equipped with the solar cell shown in FIG. 1.

As shown in FIG. 2, in the present embodiment, the transmitting display 5, the solar cell unit 6, and the light transmittable material 8 composed of a translucent material are combined as one body by molding together with a plastic material 10.

Also, as shown in FIG. 2, the plastic material 10 is provided with an opening in the front of the display 5. The plastic material 10 is also provided with a through-hole 11 for inserting the electroconductive rubber 7 and a through-hole 16 for removing an electrode of the solar cell unit 6.

The display 5, the solar cell unit 6, and the light transmitting material 8 are integrated with the plastic material 10 in this manner, whereby the display 5, the solar cell unit 6, and the light transmitting material 8 can be handled as one block and hence the handling capability such as carriage and the like and easy assembling of a watch can be improved. However, the plastic material 10 may be omitted as required and the display 5, the solar cell unit 6, and the light transmitting material 8 which are separate units may be assembled to form a watch.

FIG. 3 is a plan view showing the finished condition of the electronic watch shown in FIG. 1.

As previously mentioned, since a white translucent material formed of a ceramic is used for the light transmitting material 8, the display 5 consisting of the transmitting electro-optical display device displays, for example, 12:38:26 (o'clock) as a time function and 6 Month, 10 days, Mo (specifically, Monday) as a calendar function which is one of functions other than the time function, by supplying the electric power generated by the solar cell unit 6.

In the present embodiment, since the display 5 consisting of the transmitting electro-optical display device is extended over the entire electronic watch, a wide display surface can be obtained. Also, since the light transmitting material 8 which is formed of a translucent material such as a ceramic or the like is disposed below the transmitting display 5, reading of characters for the time and the calendar is quite easy.

Incidentally, the color of the transmitting material 8 which is the background color for the transmitting display 5 is not limited to the above white color, and therefore various colors or patterns may be used. Specifically, it may be a color or a pattern which has a beautiful visual appearance.

In the electronic watch equipped with the solar cell of the present embodiment, as previously mentioned, even if the solar cell unit 6 is arranged below the display 5 consisting of a digital display means, sufficient light can be transmitted and supplied to the solar cell unit 6 via the light transmitting display 5. At the same time, a large display area for the display 5 is available without any restriction from the solar cell unit 6.

Furthermore, since the light transmitting material 8 formed of a translucent material such as a ceramic or the like is arranged between the display 5 and the solar cell unit 6, the light transmitting material 8 serves to transmit and supply external light to the cell of the solar cell unit 6 and, at the same time, to reflect a part of the external light toward the side of the display 5, thereby making it possible to easily read a digital display such as characters and the like formed on the display 5.

Second Embodiment

Next, a second embodiment of the present invention is now explained with reference to FIG. 4.

Figure 4:
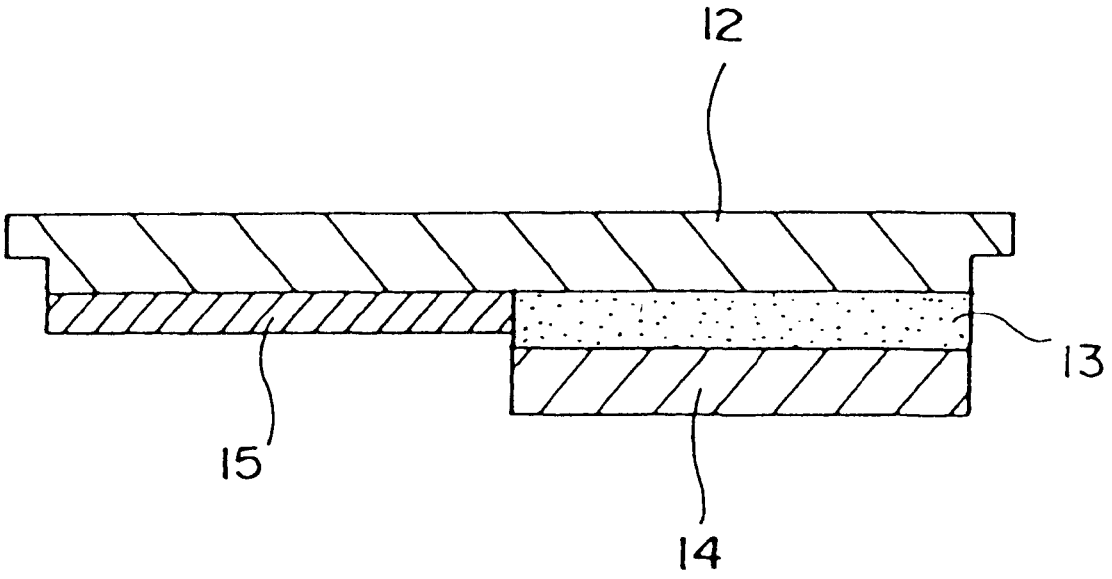
FIG. 4 is a sectional front view of a main portion in the vicinity of a solar cell showing a second embodiment of an electronic watch equipped with a solar cell according to the present invention.

FIG. 4 is a sectional front view of a main portion in the vicinity of a solar cell showing a second embodiment of an electronic watch equipped with a solar cell according to the present invention.

As shown in FIG. 4, the electronic watch equipped with the solar cell of the present embodiment is a modification of the aforementioned first embodiment. In the present embodiment, a digital display 12 comprises an electro-optical display device in which a part thereof is a light transmitting electro-optical display device and the remainder is a light reflecting electro-optical display device.

Specifically, in the present embodiment, a light transmitting material 13 formed of a translucent material and a solar cell unit 14 are disposed below the display 12 so as to extend over one half of the display 12 and a reflecting plate 15 is disposed below the display 12 so as to extend over the remaining half.

In the electronic watch of the present embodiment possessing such a structure, the display 12 of the side at which the reflecting plate 15 is placed exhibits a display having a remarkably high contrast. At the same time, charging can be performed at the side at which the solar cell unit 14 is placed while the time is displayed. Accordingly, it is desirable that displays such as time and the like which are commonly and frequently observed be disposed at the side of the reflecting plate 15 and that displays such as the day and week which are intended for relatively infrequent viewing be disposed at the side of the solar cell unit 14. Such an arrangement, in which the reflecting plate 15 and the solar cell unit 14 are placed below the display 12 so that both extend over each half of the display 12, gives an interesting effect to the watch.

In the present embodiment, though the light transmitting material 13 (and the solar cell unit 14) and the reflecting plate 15 are placed below the display 12 so that both extend over each half of the display 12, the ratio of each of the areas occupied by both is not limited to half. A structure may be adopted in which the light transmitting material 13 and the reflecting plate 15 are disposed below the display 12 so that both extend over at least a part of the display 12.

Third Embodiment

Next, a third embodiment of the present invention is explained with reference to FIG. 5.

Figure 5:
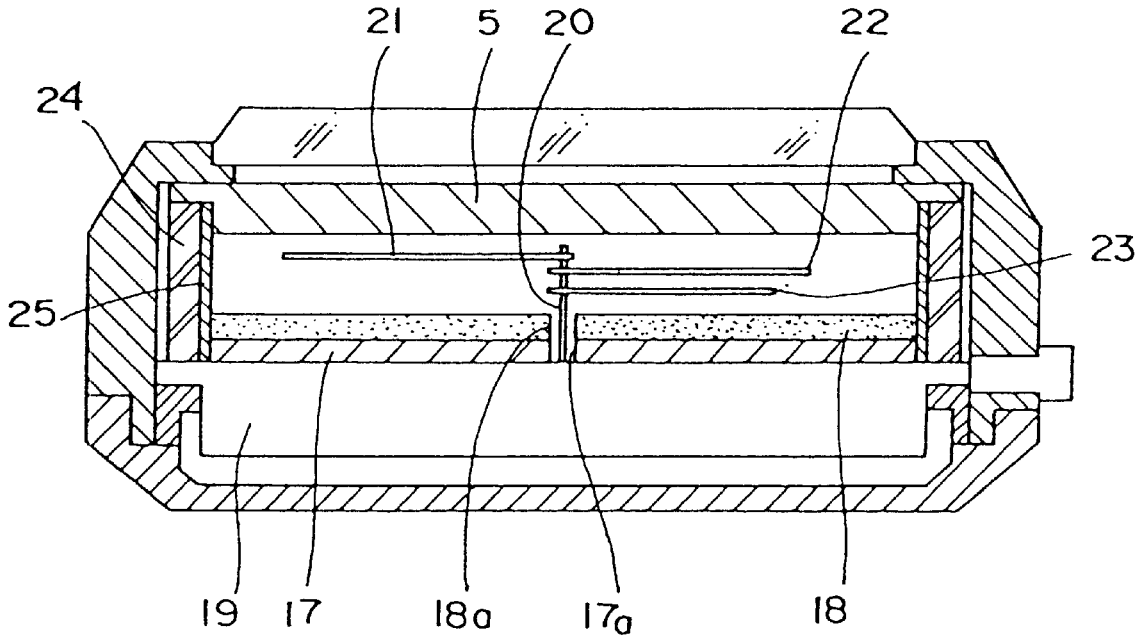
FIG. 5 is a sectional front view of a main portion showing a third embodiment of an electronic watch equipped with a solar cell according to the present invention.

FIG. 5 is a sectional front view showing a main portion of a third embodiment of an electronic watch equipped with a solar cell according to the present invention.

As shown in FIG. 5, the electronic watch equipped with the solar cell of the present embodiment is a modification of the first embodiment. It is provided with an analog display means in the digital type electronic watch shown in FIG. 1. Specifically, it is a combination watch possessing both an analog display and a digital display.

More concretely, in the electronic watch of the present embodiment, a light transmitting material 18 formed of a translucent material and a solar cell unit 17 are disposed below a display 5 comprising a light transmitting electro-optical display device so that both are mounted on a movement 19 in the same manner as in the first embodiment. Also, a space for placing an analog display means mentioned below is formed below the display 5.

The movement 19 drives the light transmitting electro-optical display device constituting the display 5 and hands for an analog display means mentioned below. A hand shaft 20 is formed projecting from almost the center of the surface of the movement 19 to a space below the display 5.

In addition, through-holes 17*a* and 18*a* for the hand shaft 20 are formed in the solar cell unit 17 and the light transmitting material 18 respectively.

A second hand 21, a minute hand 22, and an hour hand 23 are attached to the hand shaft 20 rotating in a space below the display 5.

Specifically, each of the hands 21, 22, and 23 is positioned between the display 5 and the light transmitting material 18 and the solar cell unit 17 is positioned below the light transmitting material 18.

A circuit substrate, though not shown, is disposed on the upper surface of the movement 19 and is electrically connected to the aforementioned light transmitting electro-optical display device constituting the display 5 through an electroconductive rubber 24. Though not specifically shown, similarly, the circuit substrate is electrically connected with the solar cell unit 17. Also, a parting plate 25 is disposed on the inside of the electroconductive rubber 24.

In the electronic watch of the present embodiment possessing such a structure in which a hand type analog display means is further provided in addition to the display 5 constituted of a light transmitting digital display means, since usual displays for the time and the like can be achieved by the analog display means, for example, the display 5 constituted of a digital display means is formed of a perfectly transmitting type. It is also possible to provide other functions or displays such as a chronograph, timer, and time displays for the alarm using the digital display means while the time is displayed by the analog display means.

Furthermore, the provision of the analog display means in addition to the digital display means ensures that the electronic watch of the present embodiment is improved in quality compared with a watch having only a digital display.

INDUSTRIAL APPLICABILITY OF THE INVENTION

As is clear from the above illustrations, a feature of the present invention is that the display of an electro-optical display device can be enlarged so that watches exhibiting easily visible characters can be obtained. Also, an area allowing other functions besides time to be displayed can be secured and, in addition, a solar cell with sufficient generating capacity is disposed in even such a small device as a watch, thereby providing an ecological watch having a high product value. Therefore, the electronic watch of the present invention is particularly suitable for digital display watches and for combination watches provided with a digital display means and an analog display means.

What is claimed is:

1. An electronic watch comprising:

a case body having a display window, a movement situated in the case body, light transmitting digital display means disposed above the movement in the case body to be observed from an outside through the display window, a solar cell unit interposed between a part of the light transmitting digital display means and the movement, a light transmitting material interposed between said part of the light transmitting digital display means and the solar cell unit so that light is supplied to the solar cell unit from the outside through the light transmitting digital display means and the light transmitting material, and a reflecting plate disposed under another part of the light transmitting digital display means adjacent to the solar cell unit.

2. The electronic watch according to claim 1, wherein said light transmitting material and said reflecting plate are disposed adjacent to each other under the light transmitting digital display means to provide a high contrast at the light transmitting digital display means, said solar cell being provided only under the light transmitting material.

3. The electronic watch according to claim 2, wherein said light transmitting material and said reflecting material are disposed under about half of the light transmitting digital display means, respectively.

4. The electronic watch equipped solar cell according to claim 1, wherein the light transmitting digital display means is disposed so as to extend over the entire display window.

5. The electronic watch according to claim 1, wherein the light transmitting material is formed of a translucent material and the light transmitting material transmits light and reflects a part of the light to function as a reflecting plate for the light transmitting digital display means.

6. The electronic watch according to claim 1, wherein the light transmitting material is made of a ceramic.

7. The electronic watch according to claim 1, wherein the light transmitting material transmits about 50% of the light and reflects the remainder which is about 50% of the light.

8. The electronic watch according to claim 1, wherein the light transmitting digital display means is provided with a hand type analog display means.

* * * * *